US005505504A

United States Patent [19]

Sato et al.

[11] Patent Number: 5,505,504

[45] Date of Patent: Apr. 9, 1996

[54] APPARATUS FOR TYING ONE OR MORE ARTICLES

[75] Inventors: Kiyoshi Sato; Takashi Saito; Tsutomu Saito, all of Tokyo, Japan

[73] Assignee: Bentac Co., Ltd., Tokyo, Japan

[21] Appl. No.: 347,205

[22] Filed: Nov. 21, 1994

Related U.S. Application Data

[63] Continuation of Ser. No. 19,360, Feb. 18, 1993, abandoned.

[30] Foreign Application Priority Data

Feb. 28, 1992 [JP] Japan ..... 4-078289
Feb. 15, 1993 [JP] Japan ..... 5-025661

[51] Int. Cl.[6] ..... B65H 69/04; B21F 15/04

[52] U.S. Cl. ..... 289/2; 140/57; 140/93.6; 140/119

[58] Field of Search ..... 289/1.5, 2, 17, 289/18.1; 53/417, 138.6, 138.7, 138.8, 370; 140/93 R, 93.6, 57, 119

[56] References Cited

U.S. PATENT DOCUMENTS

| | | | |
|---|---|---|---|
| 2,346,786 | of/0000 | Radeck . | |
| 2,898,817 | 8/1959 | Lutz et al. | 53/138.8 |
| 3,368,590 | 2/1968 | Welden | 140/93 R |
| 4,354,535 | 10/1982 | Powell et al. | 140/93.6 |
| 4,362,192 | 12/1982 | Furlong et al. | 140/93.6 |
| 4,558,894 | 12/1985 | Detterbeck et al. | 289/1.5 |
| 4,865,087 | 9/1989 | Geiger | 140/119 |
| 4,953,598 | 9/1990 | McCavey | 140/93.6 |

FOREIGN PATENT DOCUMENTS

| | | | |
|---|---|---|---|
| 1050165 | 3/1991 | China . | |
| 17674 | 10/1980 | European Pat. Off. . | |
| 0167795 | 1/1986 | European Pat. Off. . | |
| 51-26116 | 8/1976 | Japan . | |
| 57-44035 | 9/1982 | Japan . | |
| 192747 | 11/1982 | Japan | 289/1.5 |
| 58-2835 | 1/1983 | Japan . | |
| 58-52609 | 11/1983 | Japan . | |
| 59-39027 | 9/1984 | Japan . | |
| 63-191719 | 8/1988 | Japan . | |
| 2-29410 | 6/1990 | Japan . | |
| 4-72143 | 6/1992 | Japan . | |
| 4-201807 | 7/1992 | Japan . | |
| 5-3494 | 1/1993 | Japan . | |
| 1172079 | 11/1969 | United Kingdom . | |

*Primary Examiner*—C. D. Crowder
*Assistant Examiner*—Michael A. Neas
*Attorney, Agent, or Firm*—Armstrong, Westerman, Hattori, McLeland & Naughton

[57] ABSTRACT

A tying wire is puled out from a continuous stock. It is then bent to form a U-shaped fold of an appropriate length. The U-shaped loop of the tying wire is wound around an overlapped portion to be tied of an article or articles. A front end of the U-shaped fold is wound around the other end by a rotatable hook, thus finally twisting both ends. The tying wire is cut at a rear end an appropriate timing. The apparatus for tying is made up of a mechanism for forming a U-shaped loop of the tying wire, a mechanism for guiding the U-shaped loop to wind it around an external surface of a portion to be tied of the article or articles, a mechanism for twisting the closed end and the other end of the U-shaped loop, and a mechanism for cutting the tying wire at an appropriate timing to an appropriate length.

11 Claims, 9 Drawing Sheets

APPARATUS FOR TYING ONE OR MORE ARTICLES

This application is a continuation of application Ser. No. 08/019,360 filed Feb. 18, 1993, now abandoned.

BACKGROUND OF THE INVENTION

The present invention relates to a method and an apparatus for tying one or more articles such as reinforcing bars for construction or structural purposes, flexible containers such as bags, or the like.

As a method of tying one or more articles, particularly an overlapped portion of articles such as reinforcing bars for construction or structural purposes, or the like, there is known a method in which a worker for arranging, or placing in position, reinforcing bars winds a single piece of annealed steel wire of a predetermined length around the overlapped portion of the reinforcing bars in situ or on a construction site. It is also known to use as a tying wire a U-shaped fold or loop of an annealed steel wire which is already cut into a predetermined length. In such a case, a hooked end of a twisting tool is engaged with a closed end of the U-shaped fold. The twisting tool is then manually twisted or turned several times to thereby twist together the front end and the rear end of the U-shaped fold.

In the above-described conventional method of manually twisting a single piece of steel wire around one or more articles, particularly around the overlapped portion for tying, it is necessary to strongly hold both ends of the steel wire before winding it around one or more articles, particularly around the overlapped portion. This manual work is troublesome and a mechanical means for holding both ends was difficult to devise. If this strongly held portion gets loosened, it becomes impossible to twist the steel wire as well as to firmly and immovably tie the overlapped portion together. If the twisting is carried out excessively to ensure the tying of the articles, the steel wire may give rise to rupture. Further, in the above-described conventional method it is normal practice to hold both ends of the tying wire to be twisted with one hand and insert the hooked end of the twisting tool into the front end of the loop with the other hand, thereafter rotating the twisting tool on the construction site. This job requires a high degree of skill, and it has to be repeated many times, especially in view of tying, for example, all of the overlapped portions of the reinforcing bars on one construction site. This repetition is a hard work for the worker, and the time to be spent for this particular job becomes long. As a result, the efficiency of the tying work is lowered.

OBJECTS AND SUMMARY OF THE INVENTION

An object of the present invention is to provide a method of tying one or more articles by forming a U-shaped tying wire from a continuous stock to facilitate easy and firm tying without undue rupture of the tying wire. It is another object of the present invention to provide a tying apparatus for automatically carrying out the above-described method.

According to one aspect of the present invention, for achieving the foregoing object, the method of tying one or more articles comprises the steps of feeding a tying wire from a continuous stock; bending the tying wire to form a U-shaped fold of an appropriate length; winding the U-shaped fold of the tying wire around a portion to be tied of the article or articles; and twisting a front end and a rear end of the U-shaped fold of the tying wire together.

In one preferred mode, the entire U-shaped loop is moved forwards to a position suitable for the subsequent step of winding the U-shaped fold.

in another preferred mode, the step of winding is preceded by moving the entire U-shaped fold backwards.

Preferably, the closed end of the U-shaped fold leads the winding movement, or else, the end opposite to the closed end of the U-shaped loop also may lead the winding movement.

Preferably, the method further comprises the step of cutting the rear end of the tying wire at an appropriate timing.

According to another aspect of the present invention, a method of tying one or more articles comprises the steps of feeding a tying wire from a continuous stock; moving an intermediate portion of the pulled out tying wire towards one side to form a U-shaped loop of an appropriate length; winding the loop around a portion to be tied of the article or articles such that the closed end thereof lies substantially parallel with a rear end thereof; engaging a rotatable engaging means into a front end of the loop; and rotating the engaging means such that the front end of the loop is wound around the rear end of the loop.

According to still another aspect of the present invention, a tying apparatus for tying one or more articles comprises means for forming a U-shaped loop of a tying wire by feeding it out of a continuous stock of raw tying wire; means for guiding the U-shaped loop to wind it around an external surface of the portion to be tied of the article or articles so that the closed end and the rear end of the U-shaped loop lie substantially parallel with each other; and means for twisting the closed end and the rear end of the U-shaped loop to tie the article or articles together.

The apparatus preferably further comprises means for cutting the tying wire at an appropriate timing to an appropriate length.

Preferably, the means for forming the U-shaped loop comprises a travelling roll which is insertable into the loop for moving the tying wire to one side towards the article or articles.

In a preferred mode, the means for forming the U-shaped loop comprises a first set of rolls disposed in one path of the U-shaped loop, a second set of rolls disposed in the other path of the U-shaped loop, a deflector and a guide wheel both of which are arranged with a clearance therebetween for the tying wire to pass therethrough from the first set of rolls towards the second set of rolls.

Preferably, the second set of rolls are reversible in direction of rotation and the deflector is movable to stand clear of the movement of the U-shaped loop, or else, the first set of rolls are reversible in direction of rotation and the guide wheel is movable to stand clear of the movement of the U-shaped loop.

Preferably, the means for guiding the U-shaped loop further comprises a set of members like outside calipers one or both ends of which are movable towards and away from each other such that, when closed, there is formed on an internal side thereof a substantially circular guide surface for the U-shaped loop to pass through.

The means for guiding the U-shaped loop may further preferably comprise a member which is movable towards and away from one of the closed end and the rear end of the U-shaped loop such that the one of the closed end and the rear end can be urged towards the other end of the U-shaped loop into a position appropriate for twisting them together.

The member may be provided in two places which correspond to the closed end and the rear end, respectively, of the U-shaped loop.

The means for twisting preferably comprises a hook which is tapered to become smaller towards the front end of the hook so that it can be inserted into, and pulled out of, the closed end of the U-shaped loop.

In another preferred mode, the means for twisting comprises a pair of holding pieces front ends of which are movable towards and away from each other such that the closed end or both the closed end and the rear end of the U-shaped loop are clamped when the holding pieces are moved towards each other.

In carrying out the present invention method in one preferred mode, the apparatus is operated by a worker in tying articles such as reinforcing bars while it is hand-carried by him on a construction site.

In a preferred mode, the present invention method is performed as follows. In the following description, one or more articles are referred to as a specific example in the form of reinforcing bars E, E which are to be tied together at an overlapped portion.

When the operation of tying the overlapped portion of the reinforcing bars is started, one piece of raw tying wire is fed out of a rolled stock. By the operation of the means for forming a U-shaped fold or loop, a U-shaped tying wire "a" is formed. This operation of forming the U-shaped fold can be done in various manners. In one way, the travelling roll is moved sideways to thereby form the U-shaped loop of an appropriate length. In another way, the raw tying wire is deflected or turned in its travelling direction by the deflector towards the opposite direction. The thus formed entire U-shaped loop is transferred or moved forwards or backwards, depending on the construction or arrangement, by the reversible rotation of the appropriate set of rolls. In case the U-shaped loop is transferred backwards, this movement constitutes part of the subsequent step of winding the U-shaped loop around the article or articles. In this manner, the following step of winding the U-shaped loop is performed while one of the closed end or the opposite end, i.e., the free open end of the U-shaped loop leads the movement. This tying wire "a" is cut at an appropriate timing.

At the time when the above-described winding work has been finished, the closed front end portion and the other (i.e., the rear) end of the loop b of the tying wire "a" are twisted preferably by rotating an engaging means of the twisting means. In a preferred mode of twisting, the engaging means is caused to engage, first, with the closed loop b of the tying wire "a" which is positioned within the locus of rotation of the engaging means and, then, is operated to wind the closed loop b around the other end or the rear end portion c of the tying wire "a" as shown in FIG. 1(*b*). In case the means for twisting comprises a pair of holding pieces, the closed end alone or both the closed end and the rear end of the closed loop b are clamped by the holding pieces. The front end portion on the side of the loop b and the rear end portion c on the other side thereof are finally twisted together. In this twisting operation, since both twisting ends of the tying wire "a" are restrained or restricted by the closed loop b, the twisting movement proceeds not towards the free rear end but inwards towards the reinforcing bars E, E. In this manner, secure twisting and firm binding operations can be performed as shown in FIG. 1(*c*). Though, at this time, a large rupturing force may be applied to the tying wire "a" with the increase in the binding or tying force, a maximum binding force can be obtained by utilizing a torque limiting device (not illustrated) which is associated with the engaging means. After the above-described tying of the overlapped portion has been finished, a hook as one example of the engaging means is easily disengaged from the tying material "a" due to the taper which becomes smaller towards the front thereof, and is ready for the next round of operation.

BRIEF DESCRIPTION OF THE DRAWINGS

The above and other objects and the attendant advantages of the present invention will become readily apparent by reference to the following detailed description when considered in conjunction with the accompanying drawings wherein.

PREFERRED EMBODIMENTS OF THE INVENTION

Preferred embodiments of the present invention will now be explained with reference to the accompanied drawings.

The method and apparatus for tying one or more articles will be explained in a specific example of tying an overlapped portion of reinforcing bars for construction or structural purposes.

Figure 1A:
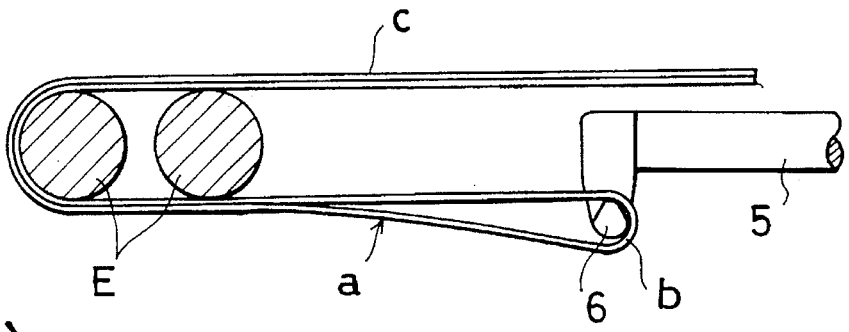
FIGS. 1(*a*) through 1(*c*) are sketches showing the condition of tying articles such as reinforcing bars by the present invention method.
Figure 1B:
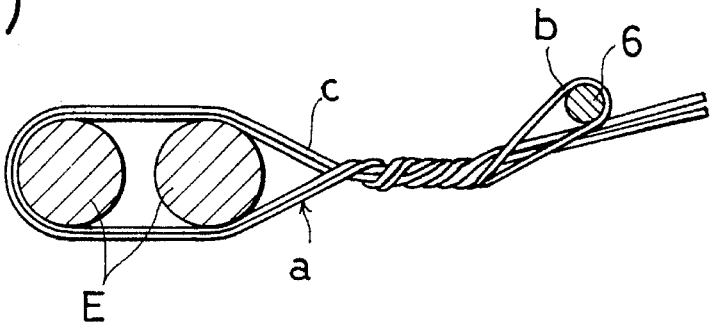
Figure 1C:
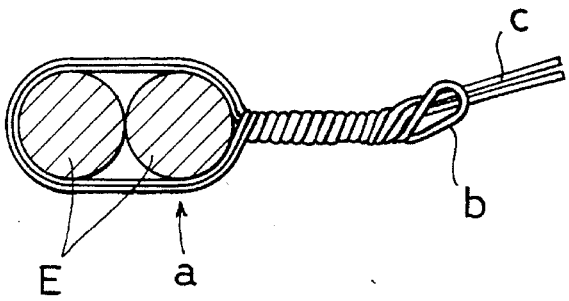
Figure 2:
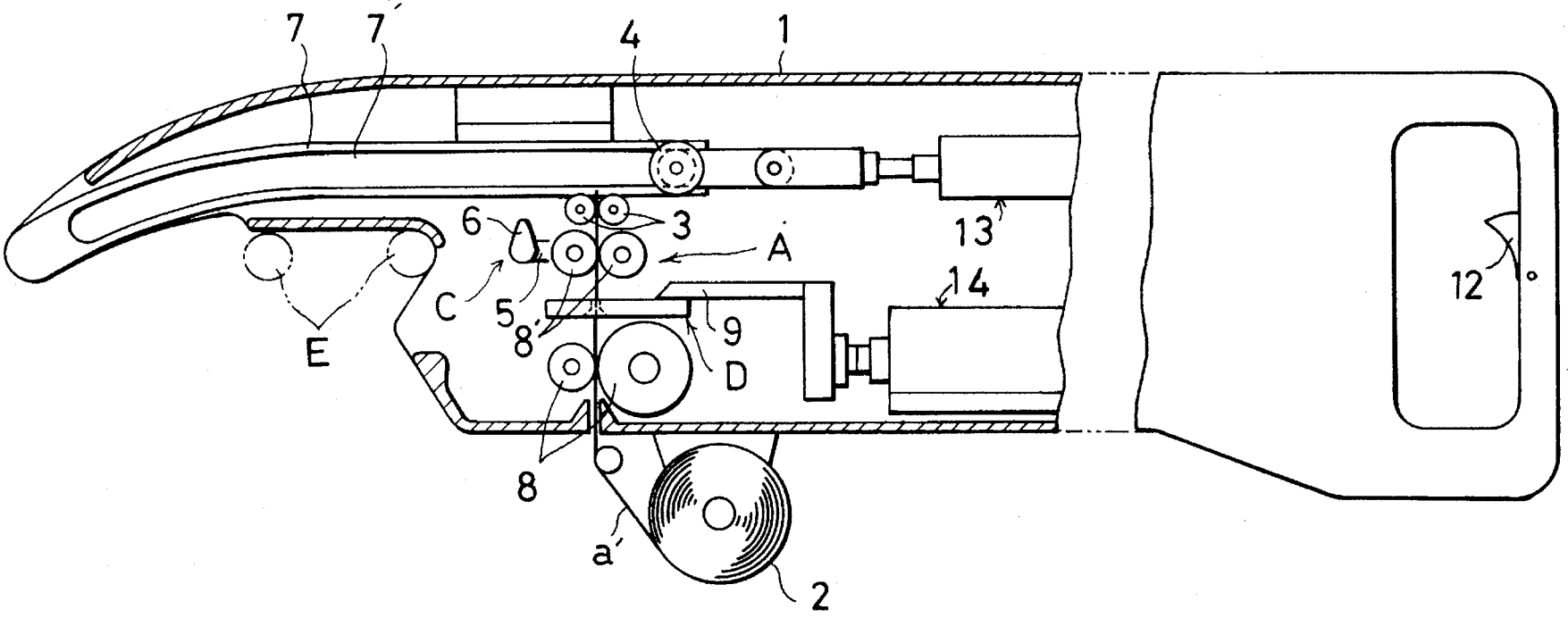
FIG. 2 is a side view, partially shown in section, of an embodiment of the present invention apparatus.

As shown mainly in FIG. 2 and also in others, a preferred embodiment of the apparatus for carrying out the present invention method is made up of a mechanism A for forming a U-shaped loop of a tying wire "a" with which the overlapped portion of the reinforcing bars E, E is tied together, a mechanism B for guiding the U-shaped loop of the tying wire "a" into a condition in which the closed front end and the rear end of the U-shaped loop are placed close enough to allow them to be twisted together, a mechanism C for twisting the tying wire at the front end and the rear end of the U-shaped loop together so that the articles are fastened together, and a mechanism D for cutting the formed tying wire "a" to a suitable length.

Each of the above-described mechanisms is incorporated into an apparatus main body 1 so that the apparatus can be operated by a driving source of relatively small electric motors or air cylinders while it is carried by an operator on a construction site. When the apparatus is put into use, the front end of the apparatus main body 1 is positioned ahead of the overlapped portion of the reinforcing bars E, E as illustrated.

Each of the above-described mechanisms is described in more detail.

Mechanism for Forming U-shaped Loop

Figure 3A:
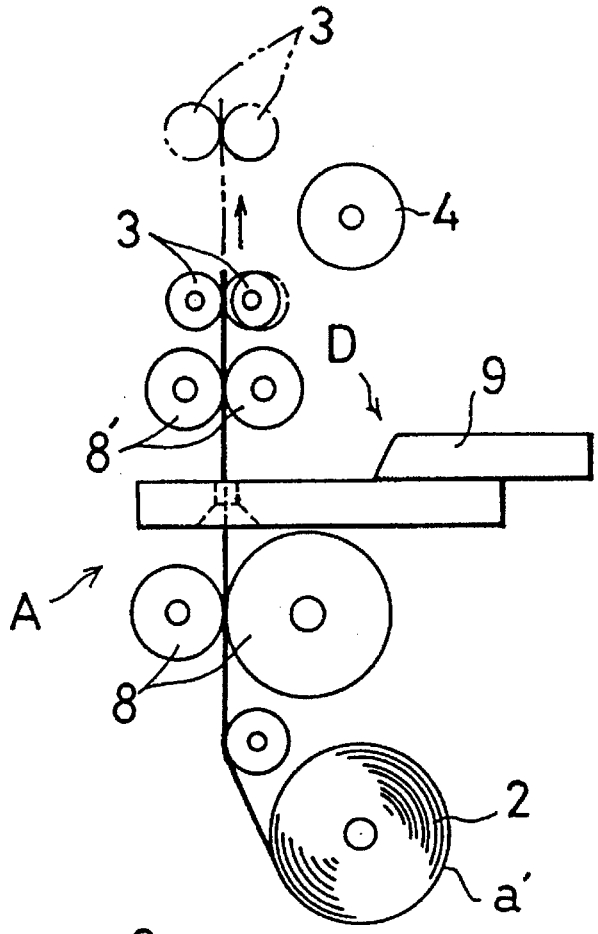
FIGS. 3(*a*) and 3(*b*) are side views of important portion of mechanism for forming a U-shaped tying wire.
Figure 3B:
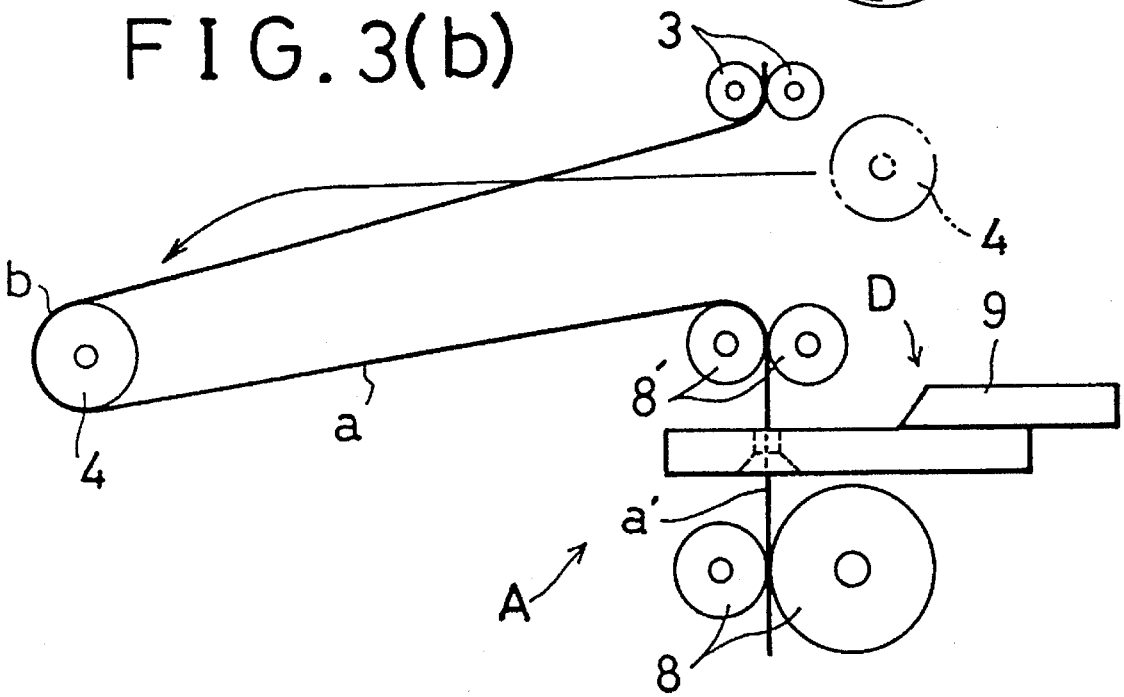

When a push button 12 or the like which is provided in the apparatus main body I as shown in FIG. 2 is pushed to start the operation of forming the U-shaped fold or loop, a pair of feed (or pull-out or take-out) rolls 8, 8 shown in FIG. 3(*a*) are started to rotate. Raw tying wire a' which is wound around a reel 2 or the like is fed, or pulled or taken out, to pass it through a pair of guide rolls 8', 8'. The front end of the raw tying wire a' is then caused to be held by a chuck 3 which is made up of a pair of rolls 3, 3 which can be moved towards and away from each other at an appropriate timing. After the chuck 3 is moved away from the guide rolls 8', 8' as illustrated by imaginary lines in FIG. 3(*a*), a travelling roll 4 in a waiting position is moved towards the front side of the apparatus main body I by an air cylinder mechanism 13 as shown in FIG. 2 along a groove 7' in a stationary guide bar 7 which is fixed to the apparatus main body 1. In this manner, an intermediate portion of the raw tying wire a' which is positioned between the chuck 3 and the guide rolls 8', 8' is moved sideways so that the pulled out portion of the raw tying wire a' is bent by the travelling roll 4 into a U-shaped fold or loop. At an appropriate timing the raw tying wire a' is cut by a cutter 9 through the operation of an air cylinder mechanism 14 at a point of the raw tying wire a' between the feed rolls 8, 8 and the guide rolls 8', 8' to thereby form a U-shaped tying wire "a" of a predetermined length. This tying wire "a" is used to tie the reinforcing bars E, E. Whenever the chuck 3 is returned to its original position, and the feed rolls 8, 8 are operated, the above-described operative steps are repeated to successively form the tying wire from a continuous stock of raw tying wire a'.

Another embodiment of the mechanism for forming U-shaped loop will now be explained with reference to FIGS. 4(*a*) and 4(*b*). In front of the reel 2 of the raw tying wire a' there are provided two sets of rolls 20*a*, 20*a* and 21*a*, 21*b*. The first set of rolls 20*a*, 20*b* are rotated in the direction to pull out the raw tying wire a' out of the reel 2. The second set of rolls 21*a*, 21*b*, on the other hand, are reversible, i.e., they can be rotated in the same direction as the first set of rolls as well as in the opposite direction. In front of these two sets of rolls, there is further provided a deflector or a guide member 22 which has a concave guide surface 22*a* on the side which faces the reel 2. A guide wheel 23 is rotatably provided in front of the guide surface 22*a* with a small clearance therebetween so as to be immovable in the vertical direction. This guide member 22 is so arranged that it is vertically movable, by an air cylinder mechanism 24 or the like, from the position shown in thick lines in FIG. 4(*b*) down to a position to stand clear of the tying wire "a" when the tying wire "a" horizontally moves to the left.

In this embodiment, the raw tying wire a' which is pulled out of the reel 2 strikes against the deflector 22 and then moves along the clearance between the guide wheel 23 and the deflecting surface (or guide surface) 22*a*. During this movement, the raw tying wire a' changes its direction by by 180 degrees by the deflecting surface 22*a* and will be pinched by the second set of rolls 21*a*, 21*b*. In this manner, the raw tying wire a' is formed into a U-shaped tying wire "a". When the amount of pulling the raw tying wire a' by the second set of rolls 21*a*, 21*b* has become sufficient, the rotation of the second set of rolls 21*a*, 21*b* as well as that of the first set of rolls 20*a*, 20*b* are stopped. At the same time, the deflector 22 is lowered by operating the air cylinder mechanism 24 to stand clear of the tying wire "a". While the rotation of the first set of rolls 20*a*, 20*b* remains the same as before, the rotation of the second set of rolls 21*a*, 21*b* is now reversed, i.e., to the same direction of rotation as that of the first set of rolls 20*a*, 20*b*. In cooperation with the first set of rolls 20*a*, 20*b*, the second set of rolls 21*a*, 21*b* thus operate to transfer or move the the U-shaped tying wire "a" forwards, i.e., in the direction in which the front end of the U-shaped loop leads the movement, out of engagement with the guide roll 23, as shown by imaginary lines in FIGS. 4(*a*) and 4(*b*). The tying wire "a" may be cut by a cutter 9 to an appropriate length at a position in front of the first set of rolls 20*a*, 20*b*. In this manner, the U-shaped tying wire "a" of a suitable length can be formed. By the above-described rotation of the first and second set of rolls 20*a*, 20*b* and 21*a*, 21*b*, the operations are repeated, thereby forming the tying wire "a" in succession.

The feeding of the raw tying wire a' may be done by rotating the reel 2 by a driving means such as an unillustrated electric motor or the like. Synchronously with this feeding operation, the feeding devices such as the feeding rolls 8, 8, rolls 20*a*, 20*b* or the like may be operated to feed the raw tying wire a'.

Mechanism for Guiding Tying Wire

Figure 5A:
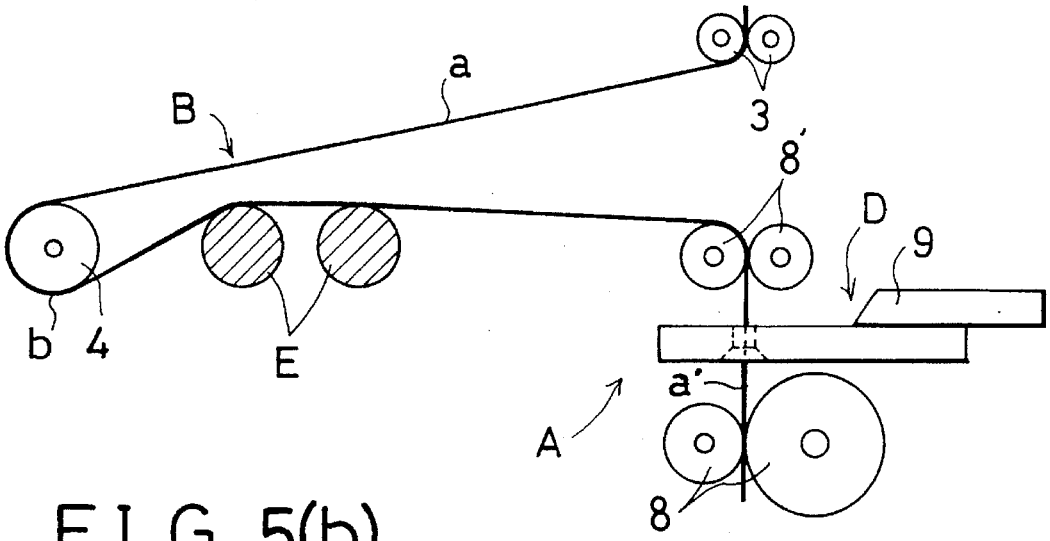
FIGS. 5(*a*) through 5(*c*) are side views showing the operation of the mechanism for guiding the tying wire.
Figure 5B:
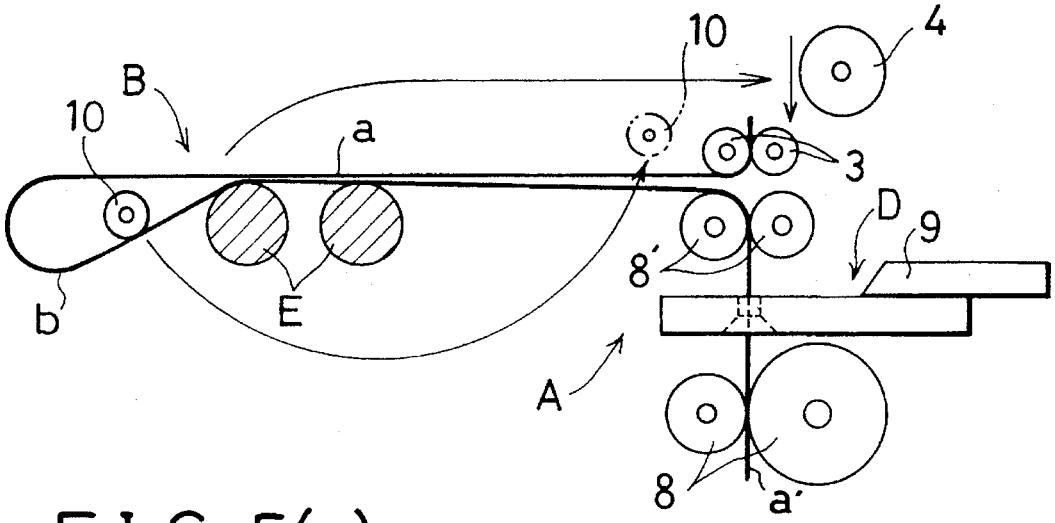
Figure 5C:
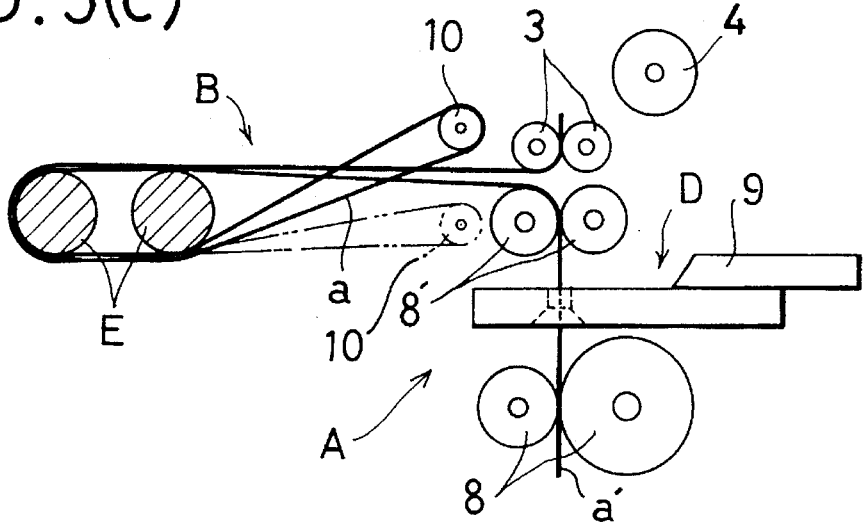

In case the U-shaped loop of tying wire "a" is positioned in front of the overlapped portion of the reinforcing wires E, E as a result of the operation for forming the U-shaped loop of tying wire "a" according to the above-described first embodiment, one side of the tying wire "a" is in contact with the overlapped portion of the reinforcing bars E, E as shown in FIG. 5(*a*). This condition is advantageous in performing the next step in succession.

When the travelling roll 4, in the embodiment in which the travelling roll 4 is used, has been returned to the waiting position as shown in FIG. 5(*b*) subsequent to the above-described operation, an operating piece 10 which is moved by an unillustrated operating mechanism into an inner side of the loop b of the U-shaped tying wire "a" synchronously with the returning movement, is moved in an arcuate manner while steering clear of the overlapped portion of the reinforcing bars E, E as shown in FIG. 5(*c*). In this operation, the folded front end portion of the loop b lies substantially parallel with the other end or the rear end of the tying wire "a" without their crossing each other as shown by imaginary lines in FIG. 5(*c*), whereby the overlapped portion of the reinforcing bars E, E is substantially enclosed by the tying wire "a".

The foregoing cutting operation of the tying raw wire a' may be performed at this time.

Figure 6A:
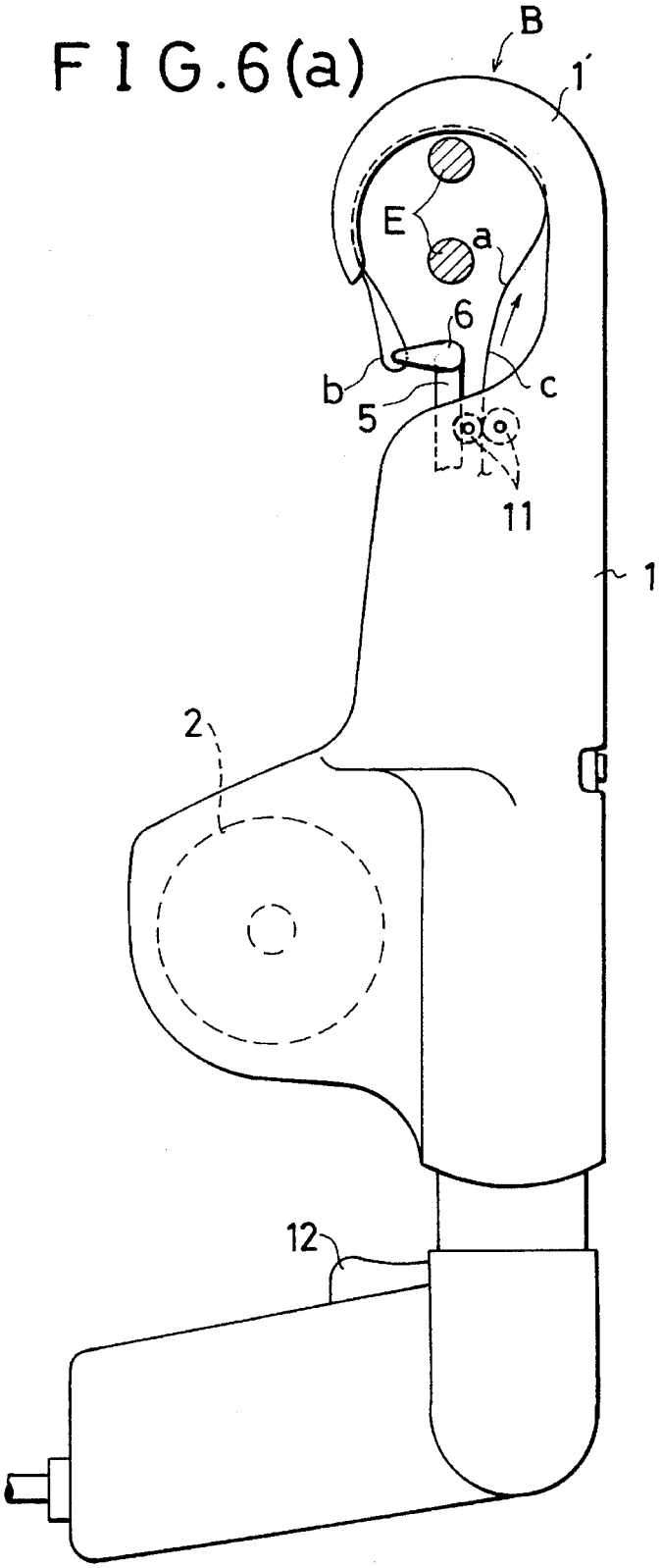
FIGS. 6(*a*) through 6(c) show side views showing other embodiments of the mechanism for guiding the tying wire.
Figure 6B:
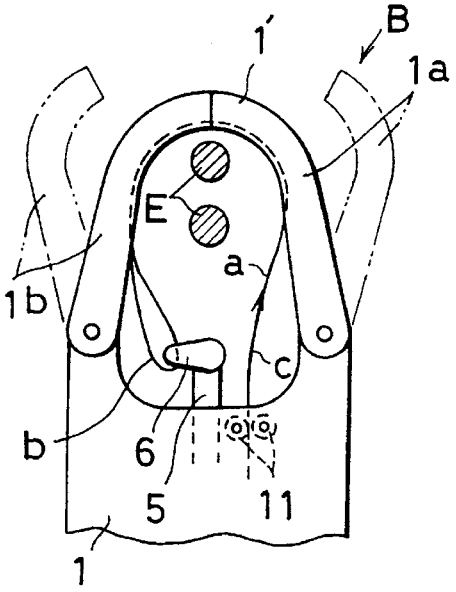
Figure 6C:
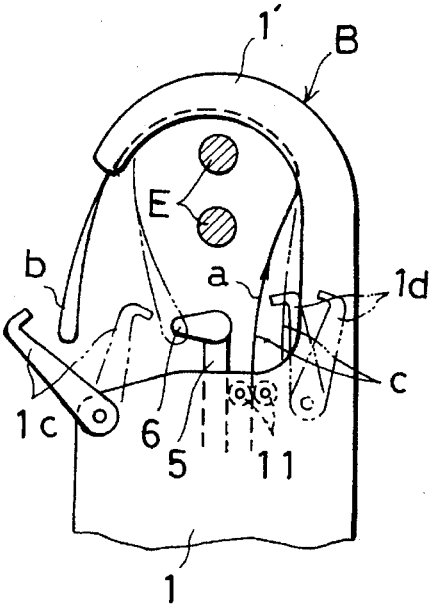

FIG. 6(*a*) shows another embodiment of the mechanism B for guiding the tying wire. The front end 1' of the apparatus main body 1 is formed into a substantial semicircle so as to enclose the external surface of the overlapped portion of the reinforcing bars E, E. The loop b of the tying wire "a" as formed by the mechanism A for forming the U-shaped loop is fed into and along an internal arcuate edge of the semicircle 1' by means of rotation of a pair of feeding or pushing rolls 11, 11. This mechanism B is also so arranged that the loop b which projects from the front end of the semicircle 1' is positioned substantially parallel with the other end or the rear end of the tying wire "a" so as to be suitable for the next twisting work.

Further, this mechanism B for guiding the tying wire can also be arranged in the following manner. Namely, as shown in FIG. 6(*b*), the front end portion 1' of the apparatus main body 1 is made up of two members in the form of outside calipers 1*a*, 1*b*front ends of which can be moved towards and away from each other such that, when closed, there is formed on the internal side thereof a substantially circular guide surface for the U-shaped loop to pass through. In this arrangement, the front end portion 1' is placed in such a position as to enclose the reinforcing bars E, E while the two members 1*a*, 1*b* are opened. Once placed, the two members 1*a*, 1*b* are moved towards each other to close the front ends thereof, thus facilitating the work of enclosing the reinforcing bars E, E. Once the two members 1*a*, 1*b* are closed, there is formed on internal surfaces thereof the curved guide surface such that the tying wire "a" can be fed by the rotation of the pushing rolls 11, 11 along the guide surface to finally enclose the reinforcing bars E, E.

In the above-described embodiment, both ends of the two members in the form of outside calipers 1*a*, 1*b* are arranged to be movable. However, needless to say, only one of them may be arranged to be movable while the other is stationary. Furthermore, the feeding of the tying wire "a" into the guide surface may be done at an appropriate timing, e,g., after the two members 1*a*, 1*b* have been closed or when they are partly, say, half, closed, or the like.

As another embodiment of this mechanism B for guiding the tying wire, the following arrangement can also be employed. Namely, as shown in FIG. 6(*c*), the extension of the hook at the front portion 1' of the apparatus main body 1 is made shorter to facilitate the work of enclosing the reinforcing bars E, E. In such an arrangement, the guide surface on the internal surface also becomes shorter. It follows that the degree of bending of the tying wire "a" is small and, therefore, that it becomes difficult to bring the both ends of the U-shaped loop substantially parallel to each other. As a solution, by the rotating or swinging movement of a swingable or rotatable member 1*c*, the end of the loop b can be moved or urged from the position shown by a thick line to a position shown by an imaginary line. In this manner, the front end and the other end of the loop can be brought into a corrected position such that both ends are made close enough to be clamped in the subsequent twisting work.

In the above-described embodiment, the swingable or rotatable member 1*c* is described to be provided only in a position which corresponds to the closed end of the U-shaped loop. However, as shown by numeral 1*d* in FIG. 6(*c*), another swingable or rotatable member may be provided in a position which corresponds to the other or opposite end (in this particular case, in the rear, free end) of the U-shaped loop. In this manner, either one or both of them 1*c*, 1*d* may be operated to urge the U-shaped loop inwards depending on the circumstances.

The mechanism B for guiding the tying wire as shown in FIG. 6(*a*) through 6(*c*) has an advantage in that the length of the apparatus main body 1 to project beyond the overlapped portion of the reinforcing bars E, E can be minimized and therefore that the tying work can be performed more advantageously.

Figure 4A:
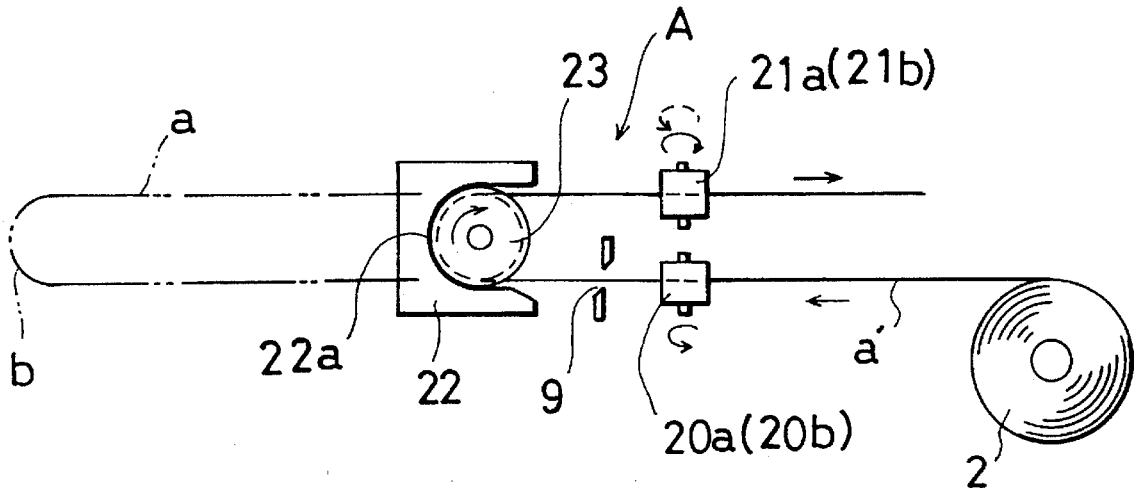
FIGS. 4(*a*) and 4(*b*) are side views of important portion of another example of mechanism for forming a U-shaped tying wire.
Figure 4B:
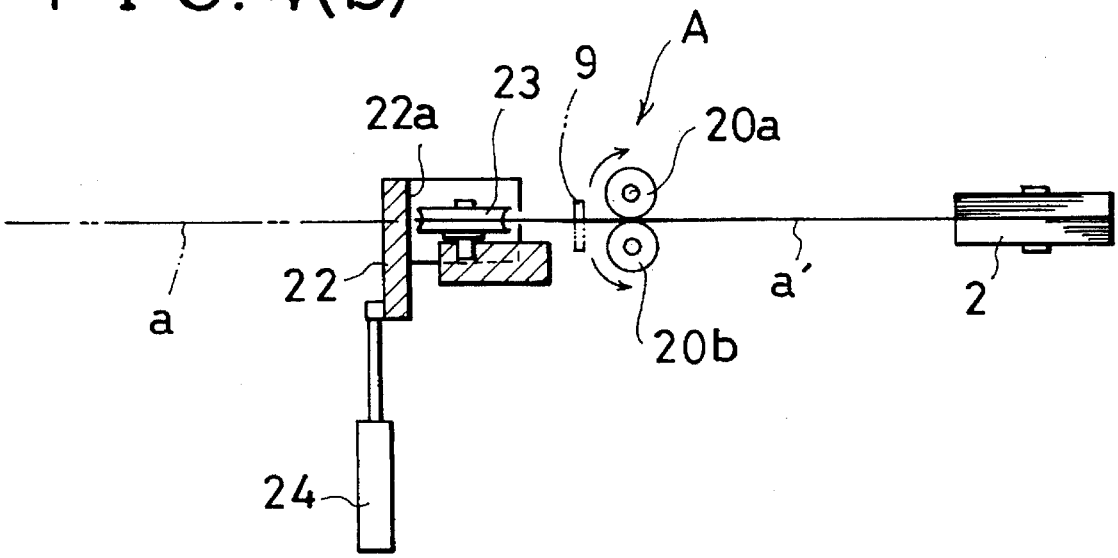

In these embodiments shown in FIG. 6(*a*) through 6(*c*), if the pushing rolls 11, 11 are replaced by the two sets of rolls 20*a*, 20*b*, 21*a*, 21*b* as shown in FIGS. 4(*a*) and 4(*b*), the guiding operation to enclose the overlapped portion of the article or articles can be performed in succession to the operation of forming the tying wire "a".

In the above-described embodiments, there have been disclosed, as the mechanism for guiding the tying wire "a", those in which the front end of the U-shaped loop b leads the winding movement in winding it around the article or articles E. There is also disclosed a case in which the opposite end (i.e., the open end) of the U-shaped loop leads the winding movement. Another embodiment for carrying it out will now be explained with reference to FIGS. 10(*a*) and 10(*b*).

Figure 10A:
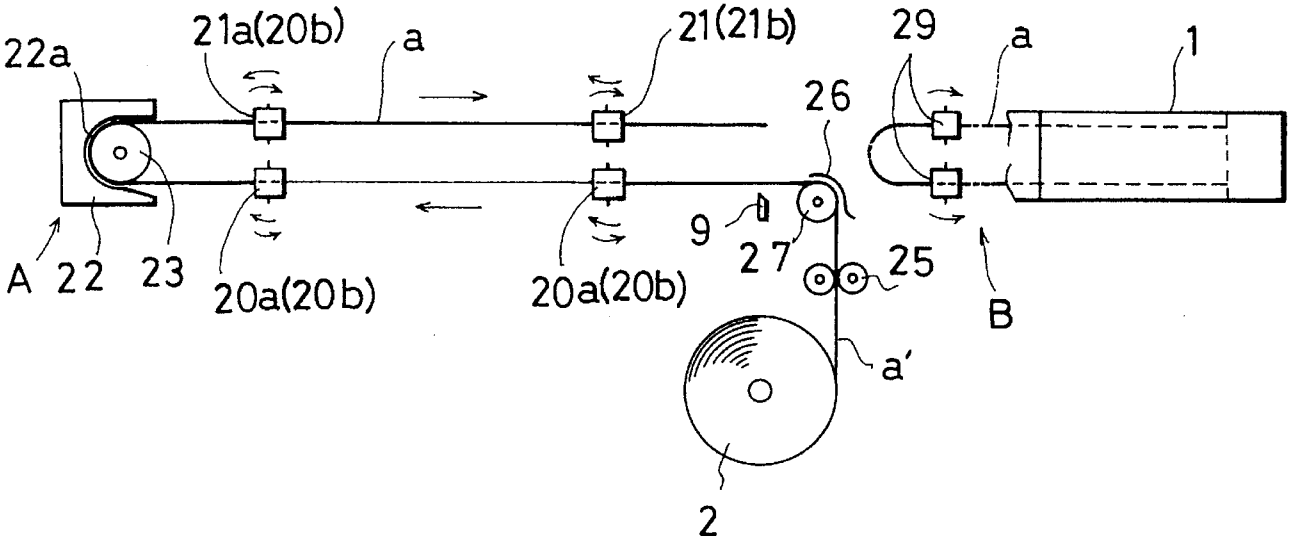
FIGS. 10(*a*) and 10(*b*) show another embodiment of the mechanisms for forming, partly inclusive of the mechanism for guiding, the tying wire.
Figure 10B:
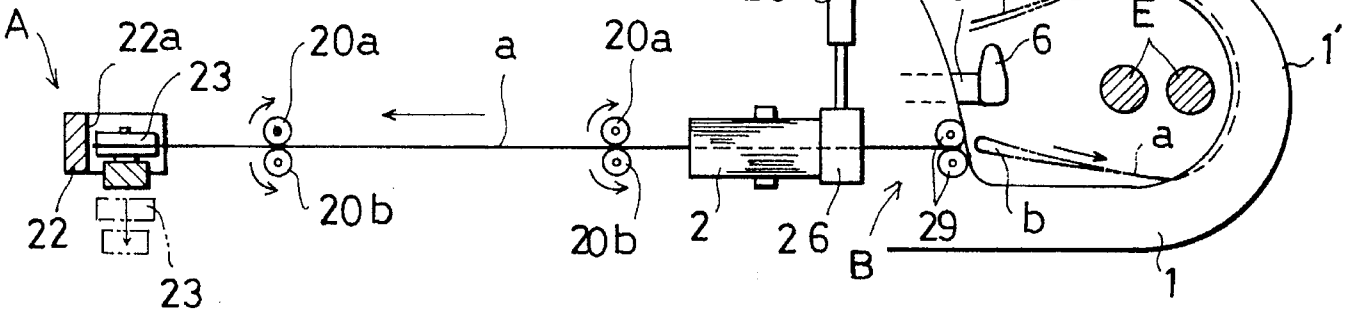

The mechanism for guiding the U-shaped loop according to this embodiment utilizes the mechanism shown in FIGS. 4(*a*) and 4(*b*) for forming the U-shaped loop. As shown in FIG. 10(*a*), the raw tying wire a' which is fed, by means of rolls 25, out of the continuous stock in the reel 2 is turned by a guide plate 26 around a guide roll 27. Then, by means of a set of rolls 20*a*, 20*b*, the raw tying wire a' is caused to pass through a clearance between the deflector 22 and the guide roll 23. As a result of this operation, the raw tying wire a' is bent into a loop, and the front end of the raw tying wire a' which comes out of the deflector 22 is pinched between another set of rolls 21*a*, 21*b*to withdraw or feed the raw tying wire a' to the opposite side. When it has been extended to a suitable length, it is cut by the cutter 9, thereby forming a U-shaped tying wire "a" with a closed loop on one end thereof. After the tying wire "a" has been obtained or formed, the guide roll 23 is positioned or lowered, as shown in FIG. 10(*b*), away from the operating position and, at the same time, the guide plate 26 is also moved away from the guide roll 27 by an air cylinder mechanism 28 or the like to stand clear of the horizontal movement of the tying wire "a". Then, the rotation of the guide rolls 20*a*, 20*b* is reversed such that, in cooperation with the other rolls 21*a*, 21*b*, the entire U-shaped loop of the tying wire "a" is moved to the opposite direction (i.e., to the direction away from the deflector). During this movement, the tying wire "a" is transferred to pushing rolls 29, 29 so that the tying wire "a" is fed from the other end, i.e., the free (not looped) end, as shown in FIG. 10(*b*) along the hooked internal surface at the front end of the apparatus main body 1. In this manner, the article or articles E are enclosed by the tying wire "a".

In case one end or both ends of the U-shaped loop are moved or urged inwards to correct the position thereof for subsequent tying work, one of two rotatable or swingable members 1*c*, 1*d* as shown in FIG. 6(*c*) may be used also in this embodiment.

As described above, by means of the mechanism B for guiding the U-shaped loop b of the guiding wire "a", the front end and the rear (i.e., the open, free) end of the U-shaped loop b of the tying wire "a" are brought to a substantially parallel condition close enough to be twisted together in the subsequent twisting operation.

Mechanism for Twisting Tying Wire

Figure 7A:
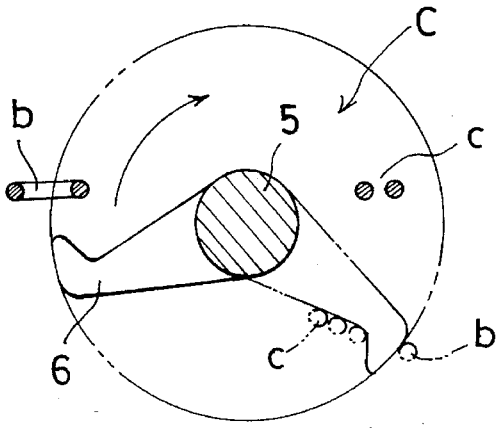
FIGS. 7(*a*) and 7(*b*) are front views of an important portion showing the operation of the mechanism for twisting the tying wire.
Figure 7B:
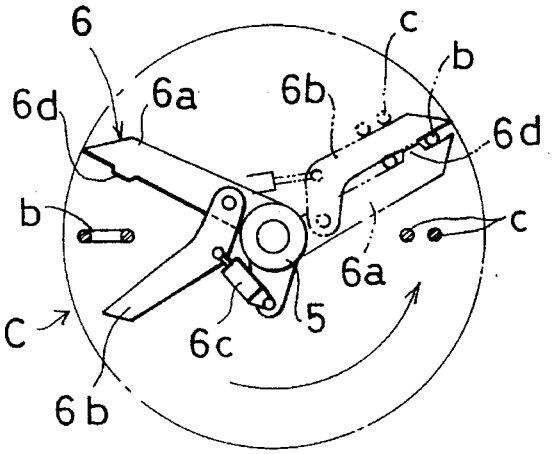
Figure 7C:
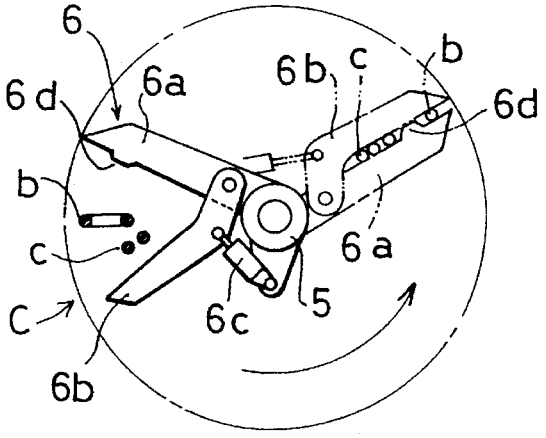

The mechanism C for twisting the tying wire "a" comprises an engaging means which is made up of a twistable shaft 5 to be rotated by a driving source such as an electric motor or the like, and a hook 6 which is provided in a projecting manner at substantially the front of the twistable shaft 5. By rotating the hook 6 several times, the hook 6 is engaged, by insertion, with the loop b of the tying wire "a" which is positioned within the locus of rotation of the hook 6 as shown in FIG. 7(*a*). At the same time, the twistable shaft 5 is rotated such that the thus engaged loop b is wound around the other ends or the rear ends c of the two pieces of substantially parallel tying wire "a", the size of the loop b becomes smaller to tighten the rear ends c, thereby gradually twisting them together to firmly fasten the overlapped portion of the reinforcing bars E, E.

The front end of the hook 6 is made into a taper which becomes smaller towards the front end thereof as shown in FIG. 7(*a*) so that the inserting engagement of the hook 6 into, and pulling it out of, the loop b can be facilitated.

As another example of the above-described mechanism C for twisting the tying wire, a hook in the form of a pair of scissors as shown in FIG. 7(*b*) may also be used.

The hook 6 comprises a pair of holding pieces 6*a*, 6*b* which are provided at substantially the end of the twistable shaft 5 so as to be movable towards and away from each other by means of an air cylinder mechanism 6*c* or the like. Once the loop b is grasped when the twistable shaft 5 is twisted or rotated with the pair of holding pieces 6*a*, 6*b* opened, the holding pieces 6*a*, 6*b* are closed to securely hold the hook 6 and then rotated to twist the tying wire "a" as in the above-described manner. In this example, a projection 6*d* may also be provided on an inner intermediate portion of one of the holding pieces. In this arrangement, in holding the tying wire "a", the projection 6*d* is engaged with the loop b, thereby preventing the loop b from being released out of engagement during twisting operation.

In the above-described embodiment of twisting by means of the hook 6, there is also a case in which, as shown in FIG. 7(*c*), both the loop b and the rear end portion c of the other side of the U-shaped fold are pinched together.

Mechanism for Cutting Tying Wire

The mechanism D for cutting the tying wire is, as explained above, made up of a cutter 9 which is operated by the air cylinder mechanism 14. Other arrangements than the above may, of course, be employed for this cutting mechanism.

Figure 8:
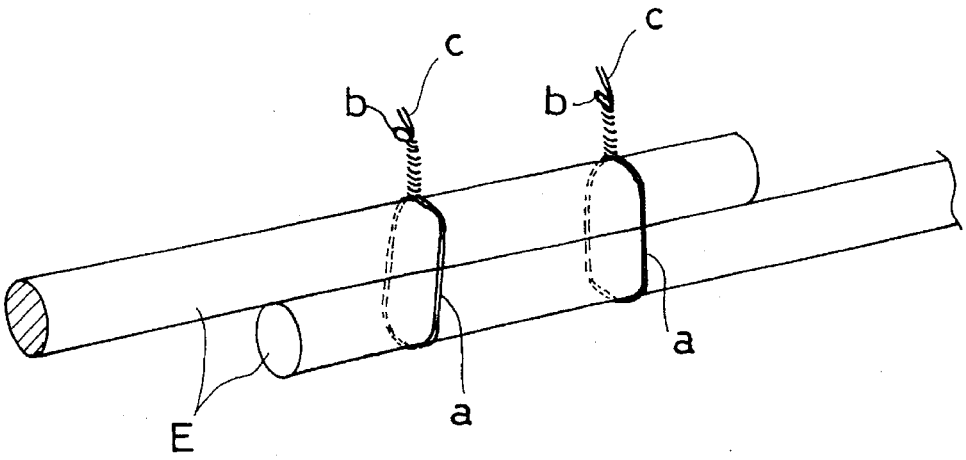
FIG. 8 is a perspective view showing the tying condition when bar-like articles are connected together in the axial direction.
Figure 9A:
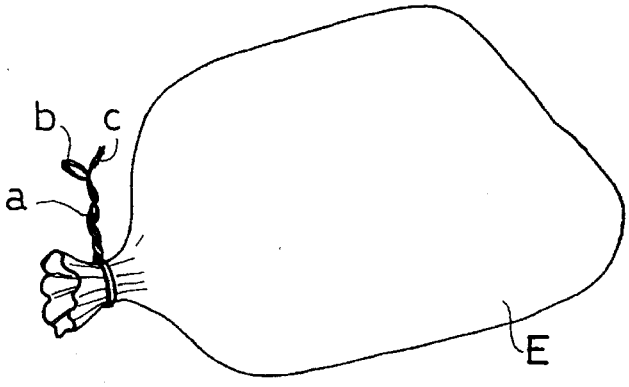
FIGS. 9(*a*) and 9(*b*) are perspective views of other embodiments when a closed mouth or mouths of a bag or bags are tied together.
Figure 9B:
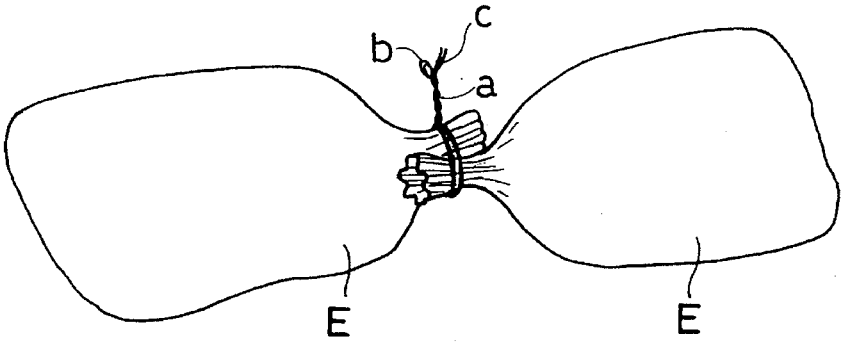

In the above-described embodiment, reinforcing bars are used as the articles to be tied at the overlapped portion. However, the articles to be tied may be other bar-like materials E such as bars, pipes, bamboos, or the like which lie parallel to each other and are to be tied together at one or more the overlapped portions, as shown in FIG. 8. The overlapped portion of two or more materials to be tied may cross each other at right angles as well as at angles other than right angles. One or more articles to be tied may, as shown in FIGS. 9(*a*) and 9(*b*), also be such a closed mouth or mouths of one or more flexible container or containers such as a bag or bags E as are aligned together for tying with the tying wire.

As described above, according to the present invention, since the tying work is performed by forming the U-shaped tying wire out of the continuous stock, the working efficiency is improved. Further, since the operating mechanism is integrated into the apparatus which can be hand-carried by the operator and its operation is automated, the operations of forming the tying wire, winding the tying wire around the article or articles, twisting the tying wire, and cutting it can be performed in a consecutive manner whenever the starting signal is given. Therefore, the labor of repeated manual operation, with the worker's largely bending himself over the over the article or articles, of the conventional method can be remarkably reduced. The time for performing the same extent of work is reduced and the working efficiency is improved.

It is readily apparent that the above-described method and apparatus for tying one or more articles meet all of the objects mentioned and also have the advantage of wide commercial use. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A tying apparatus for tying one or more of articles, the apparatus comprising:

means for forming a U-shaped loop of a tying wire by feeding it out of a continuous stock of raw tying wire, said means comprising a first set of rolls disposed in one path of the U-shaped loop, a second set of rolls disposed in the other path of the U-shaped loop and means for deflecting the tying wire between said first set of rolls and said second set of rolls;

means for guiding the U-shaped loop to wind it around an external surface of a portion to be tied of the article or articles so that a closed end and a rear end of the U-shaped loop lie substantially parallel with each other;

means for twisting the closed end and the rear end of the U-shaped loop to tie the article or articles together; and means for cutting a rear end of the tying wire at an appropriate timing to an appropriate length.

2. A tying apparatus according to claim 1, wherein said means for deflecting the tying wire comprises a deflector having a substantially semicircular deflecting surface facing the tying wire and a guide wheel which is disposed inside said semicircular deflecting surface with a clearance therebetween to allow for passage of the tying wire.

3. A tying apparatus according to claim 2, wherein the second set of rolls are reversible in direction of rotation and including means for moving said means for deflecting so as to stand clear of the movement of the U-shaped loop.

4. A tying apparatus according to claim 2, wherein the first set of rolls are reversible in direction of rotation and including means for moving the guide wheel so as to stand clear of the movement of the U-shaped loop.

5. A tying apparatus according to claim 1, wherein said means for guiding the U-shaped loop includes a set of member like outside calipers at least one end of which is movable towards and away from the other such that, when closed, there is formed on an internal side thereof a substantially circular guide surface for the U-shaped loop to pass through.

6. A tying apparatus according to claim 1, wherein said means for guiding the U-shaped loop includes a member which is movable towards and away from one of the closed end and the rear end of the U-shaped loop such that the one of closed end and the rear end can be urged towards the other end of the U-shaped loop into a position appropriate for twisting them together.

7. A tying apparatus according to claim 6, wherein said member is provided in two places which correspond to the closed end and the rear end, respectively, of the U-shaped loop.

8. A tying apparatus according to claim 1, wherein said means for twisting comprises a hook which is tapered to become smaller towards the front end of the hook and which is capable of being inserted into, and pulled out of, the closed end of the U-shaped loop.

9. A tying apparatus according to claim 1, wherein said means for twisting comprises a pair of holding pieces front ends of which are movable towards and away from each other such that at least one of the closed end and both the closed end and the opposite end of the U-shaped loop is clamped by the holding pieces when the holding pieces are moved towards each other.

10. A tying apparatus according to claim 1, wherein said means for cutting the rear end of the tying wire is electrically operated.

11. A tying apparatus according to claim 1, wherein said means for cutting the rear end of the tying wire is pneumatically operated.

* * * * *